US005682656A

United States Patent [19]

Lesley

[11] Patent Number: 5,682,656

[45] Date of Patent: Nov. 4, 1997

[54] CONTINUOUS PROCESS TO WRAP ENTANGLED YARN

[75] Inventor: Bascum G. Lesley, Pickens, S.C.

[73] Assignee: Milliken Research Corporation, Spartanburg, S.C.

[21] Appl. No.: 734,307

[22] Filed: Oct. 21, 1996

Related U.S. Application Data

[63] Continuation of Ser. No. 610,082, Feb. 29, 1996, abandoned.

[51] Int. Cl.[6] ..... D02G 1/18; D02G 1/16; D02J 1/08

[52] U.S. Cl. ..... 28/172.1; 28/271

[58] Field of Search ..... 28/172.1, 271, 28/178, 187

[56] References Cited

U.S. PATENT DOCUMENTS

| | | | |
|---|---|---|---|
| 3,591,955 | 7/1971 | Fujita | 28/271 |
| 4,644,622 | 2/1987 | Bauer et al. | 28/172.1 |
| 4,905,355 | 3/1990 | Bauer et al. | 28/187 |
| 5,148,586 | 9/1992 | Coons, III | 28/271 |
| 5,295,287 | 3/1994 | Chateau | 28/187 |
| 5,379,501 | 1/1995 | Goineau | 28/271 |
| 5,590,447 | 1/1997 | Goineau | 28/172.1 |

FOREIGN PATENT DOCUMENTS

| | | | |
|---|---|---|---|
| 50-26661 | 9/1975 | Japan | 28/271 |
| 62-149932 | 7/1987 | Japan | 28/172.1 |

*Primary Examiner*—Andy Falik

*Attorney, Agent, or Firm*—Terry T. Moyer; Earle R. Marden

[57] ABSTRACT

Method to continuously merge two multifilament yarns supplied from bobbins on a creel by merging and entangling the two yarns in a commingling air jet and supplying directly to a warper to form a warp beam.

2 Claims, 1 Drawing Sheet

CONTINUOUS PROCESS TO WRAP ENTANGLED YARN

This application is a continuation of application under 37 C.F.R. §1.62 of prior application Ser. No. 08/610,082 now abandoned filed on Feb. 29, 1996, of Bascum G. Lesley for CONTINUOUS PROCESS TO WARP ENTANGLED YARN.

This invention relates generally to the continuous production of a warp beam of a multiplicity of merged or entangled yarns from a plurality of bobbins mounted in a creel.

It is known to air entangle a multiplicity of yarns from a bobbin into a single yarn and then take up the merged or entangled yarn on another bobbin which is combined with other bobbins and supplied to a warp beam. The supplied yarns can be yarns of the same color or texture or can be yarns of opposite colors. These yarns normally are taken up on a bobbin prior to warping and require the additional step or steps of loading them onto a creel and then threading them up to a warper to provide a warp beam of such yarns.

It is therefore an object of this invention to provide a continuous process of merging a plurality of yarns from bobbins mounted on a creel and, in line, continuously directing the merged yarns on a warp beam.

Figure 1:
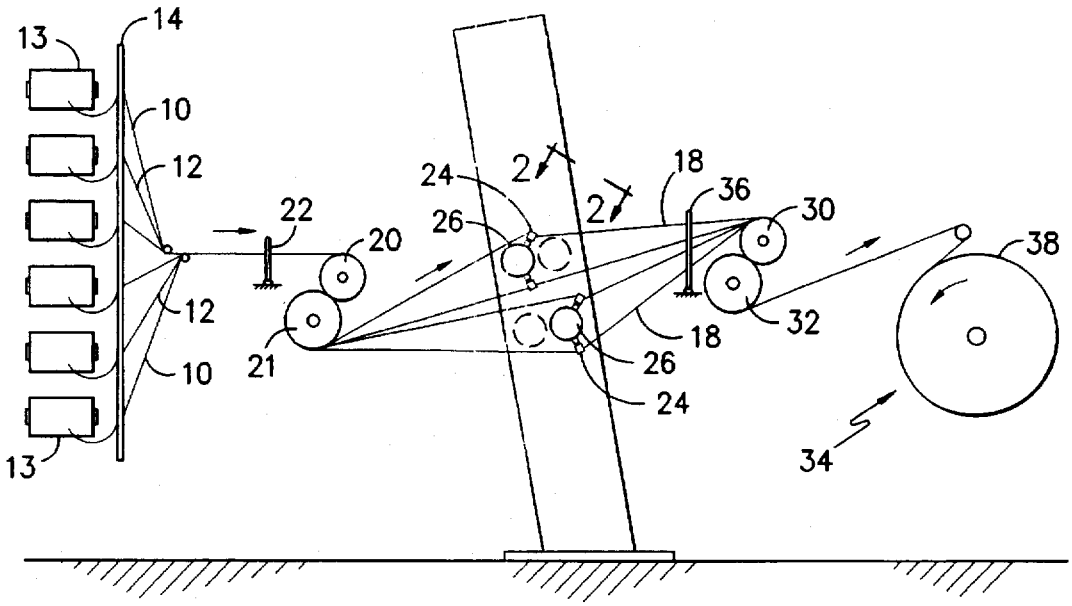
Figure 2:
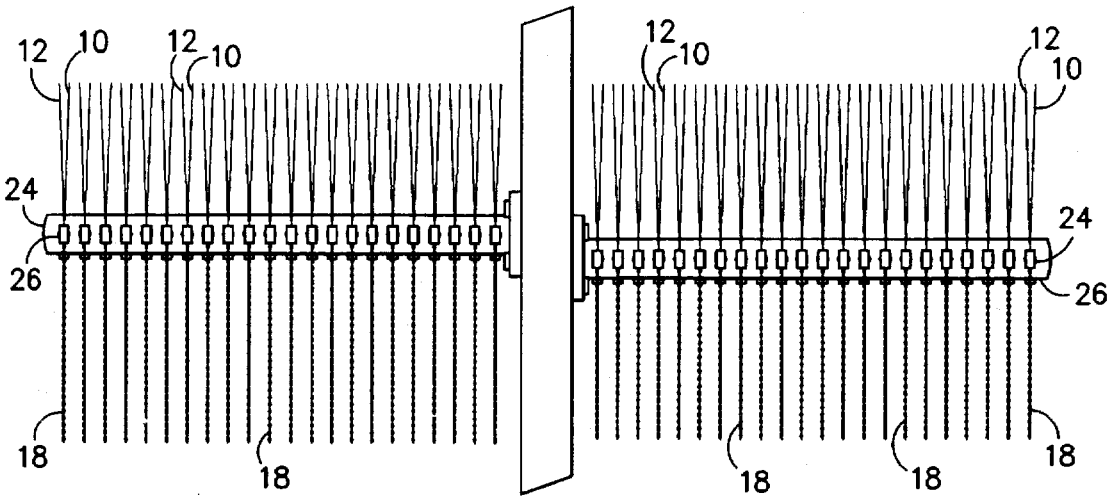

Other objects and advantages of the invention will become clearly apparent as the specification proceeds to describe the invention with reference to the accompanying drawing, in which:

FIG. 1 is a side schematic view of the new and improved process and FIG. 2 is a top view taken on line 2—2 of FIG. 1.

Looking now to the drawings, the reference numbers 10 and 12 represent single ply, 250 denier, 100 filament polyester yarns that are being supplied from bobbins 13 on a creel 14. In the preferred form of the invention, the yarn 10 is light grey and the yarn 12 is a dark grey in order to form a heather yarn 18 but it should be understood that other synthetic filament yarns, such as nylon, of different deniers, numbers of filaments and colors can be used within the scope of the invention.

The yarns 10 and 12 are delivered from the creel 14 to feed rolls 20 and 21 through a comb 22 which supplies one yarn 10 and one yarn 12 to each air entanglement jet 24 mounted on the air manifold 26 supplying air to each air jet 24 so that they operate at a pressure of about 60 psi to entangle each pair of yarns 10 and 12. Since the yarns 10 and 12 are different colors, the entangled yarn 18 has a heather appearance and is basically a two ply, 250 denier, 200 filament yarn. To allow the jets 24 to provide this heather effect, the output feed rolls 30 and 32 are supplying yarn to the warper 34 at a rate of 400 meters/minute while the input feed rolls are supplying yarn at a rate of about 409 meters providing an overfeed of yarn of about 2.3%. This overfeed can vary between 2 and 3%. Prior to the output rolls 30 and 32 the entangled yarns 18 each pass through a separate space in the dent 36 to maintain them separate as the feed rolls 30 and 32 feed directly without further treatment them to the warp beam 38 of the warper 34 as shown in FIG. 1.

The above described process provides an entangled yarn, preferably a heather yarn, warped and ready for use in a single continuous process from bobbins to the warp beam eliminating the intermediate steps of winding bobbins and recreeling at the warper to form a warp beam. Furthermore, the continuous system described provides a yarn having a heather hand and appearance especially when knit or woven into a fabric. Also when the yarn is used in a fabric such as a slit double plush fabric, the filaments stand up so that the fabric does not require any finishing operations such as brushing to provide an upstanding pile.

It is contemplated that modifications of the process can be made without departing from the scope or spirit of the invention and it is desired to be limited only by the scope of the claims.

I claim:

1. A method to continuously produce a warp beam of merged multifilament yarns from a plurality of yarns wound on bobbins comprising the steps of: providing a plurality of bobbins having yarn thereon dissimilar to yarn on other bobbins, supplying a plurality of sets of dissimilar yarns in sheet form directly without drawing or texturing into a commingling air jet, entangling the yarns in each set in the air jet and continuously supplying the entangled yarns without further treatment directly onto a warp beam.

2. The method of claim 1 wherein the dissimilar yarns are of different colors and the sheet of entangled yarn formed is a heather yarn.

* * * * *

UNITED STATES PATENT AND TRADEMARK OFFICE

CERTIFICATE OF CORRECTION

PATENT NO. : 5,682,656
DATED : November 4, 1997
INVENTOR(S) : Bascum G. Lesley

It is certified that error appears in the above-identified patent and that said Letters Patent is hereby corrected as shown below:

Title page, item [54], and col. 1, line, in the title, delete-- the word "wrap" insert the word "WARP"--.

Signed and Sealed this

Tenth Day of March, 1998

*Attest:*

*Attesting Officer*

BRUCE LEHMAN

*Commissioner of Patents and Trademarks*